US006447263B1

(12) United States Patent
Cooke et al.

(10) Patent No.: US 6,447,263 B1
(45) Date of Patent: Sep. 10, 2002

(54) FUEL PUMP WITH AUXILIARY PUMPING CHAMBER

(75) Inventors: Michael Peter Cooke; John Roderick Jefferson, both of Gillingham (GB)

(73) Assignee: Delphi Technologies, Inc., Troy, MI (US)

( * ) Notice: Subject to any disclaimer, the term of this patent is extended or adjusted under 35 U.S.C. 154(b) by 1 day.

(21) Appl. No.: 09/645,129

(22) Filed: Aug. 24, 2000

(30) Foreign Application Priority Data

Aug. 27, 1999 (GB) ..... 9920200

(51) Int. Cl.[7] ..... F04B 49/00
(52) U.S. Cl. ..... 417/297; 417/307; 123/90.48
(58) Field of Search ..... 417/297, 307, 417/559; 123/90.48

(56) References Cited

U.S. PATENT DOCUMENTS

| | | | | |
|---|---|---|---|---|
| 2,702,008 A | | 2/1955 | Stockard | |
| 3,068,794 A | * | 12/1962 | Morris et al. | 417/307 |
| 3,501,099 A | * | 3/1970 | Benson | 239/584 |
| 3,857,374 A | * | 12/1974 | Glikin et al. | 123/139 |
| 4,164,917 A | * | 8/1979 | Glasson | 123/321 |
| 4,583,508 A | * | 4/1986 | Schechter | 123/449 |
| 5,464,330 A | | 11/1995 | Prince et al. | |

FOREIGN PATENT DOCUMENTS

| | | | |
|---|---|---|---|
| DE | 19612413 | 10/1997 | |
| EP | 863306 | 9/1998 | |
| GB | 837087 | 6/1960 | 417/268 |
| GB | 1062575 | 3/1967 | 417/268 |

* cited by examiner

*Primary Examiner*—Cheryl J. Tyler
(74) *Attorney, Agent, or Firm*—Thomas N. Twomey

(57) ABSTRACT

A fuel pump includes a pumping plunger reciprocable within a bore formed in a pump housing under the influence of a cam drive arrangement. The cam drive arrangement includes a reciprocable tappet member, a surface associated with the tappet member defining, in part, an auxiliary pumping chamber. A flow path interconnects the auxiliary pumping chamber and the bore such that fuel displaced from the auxiliary pumping chamber, in use, can be supplied through the flow path to the bore.

20 Claims, 1 Drawing Sheet

FUEL PUMP WITH AUXILIARY PUMPING CHAMBER

TECHNICAL FIELD

The invention relates to a fuel pump for use in supplying fuel to a compression ignition internal combustion engine.

BACKGROUND OF THE INVENTION

A known high pressure fuel pump for use in supplying fuel to a compression ignition internal combustion engine comprises a pumping plunger reciprocable within a plunger bore under the influence of a cam drive arrangement. It is usual to provide a low pressure pump, for example in the form of a vane pump, to permit charging of a pump chamber of the high pressure pump within the time available. However, the provision of such a separate low pressure pump results in the fuel system being relatively complex, bulky and expensive.

It is an object of the invention to provide a fuel pump in which the provision of an auxiliary low pressure pump can be avoided.

SUMMARY OF THE INVENTION

According to the present invention there is provided a fuel pump comprising a pumping plunger reciprocable within a bore formed in a pump housing under the influence of a cam drive arrangement, the cam drive arrangement including a reciprocable tappet member, a surface associated with the tappet member defining, in part, an auxiliary pumping chamber, and a flow path interconnecting the auxiliary pumping chamber and the bore such that fuel displaced from the auxiliary pumping chamber, in use, can be supplied through the flow path to the bore.

By using the motion of the tappet member to pump fuel at relatively low pressure to the bore, the provision of a separate, auxiliary low pressure pump can be avoided thereby reducing the complexity, weight and cost of a fuel system including the pump.

The auxiliary pumping chamber is conveniently defined between the tappet member and the pump housing. The tappet member is preferably moveable to a position in which the tappet member is spaced from the pump housing, permitting fuel to flow to the auxiliary pumping chamber. An outlet valve is conveniently provided in the flow path to prevent the return of fuel to the auxiliary pumping chamber. A metering valve, for example a piezoelectrically controlled metering valve, may be provided in the flow path.

A pressure regulator may be provided to control the fuel pressure within the flow path. The pressure regulator conveniently controls the fuel pressure by controlling the rate at which fuel is able to escape from the flow path.

Preferably, the tappet member is reciprocable within an additional bore provided in a pump body part. The tappet member is preferably provided with means for substantially preventing relative angular movement of the tappet member with respect to the pump body part. For example, the pump body part may carry a pin which rides within a slot provided in the tappet member.

BRIEF DESCRIPTION OF THE DRAWINGS

The invention will further be described, by way of example, with reference to the accompanying drawings, in which.

DESCRIPTION OF THE PREFERRED EMBODIMENT

Figure 1:
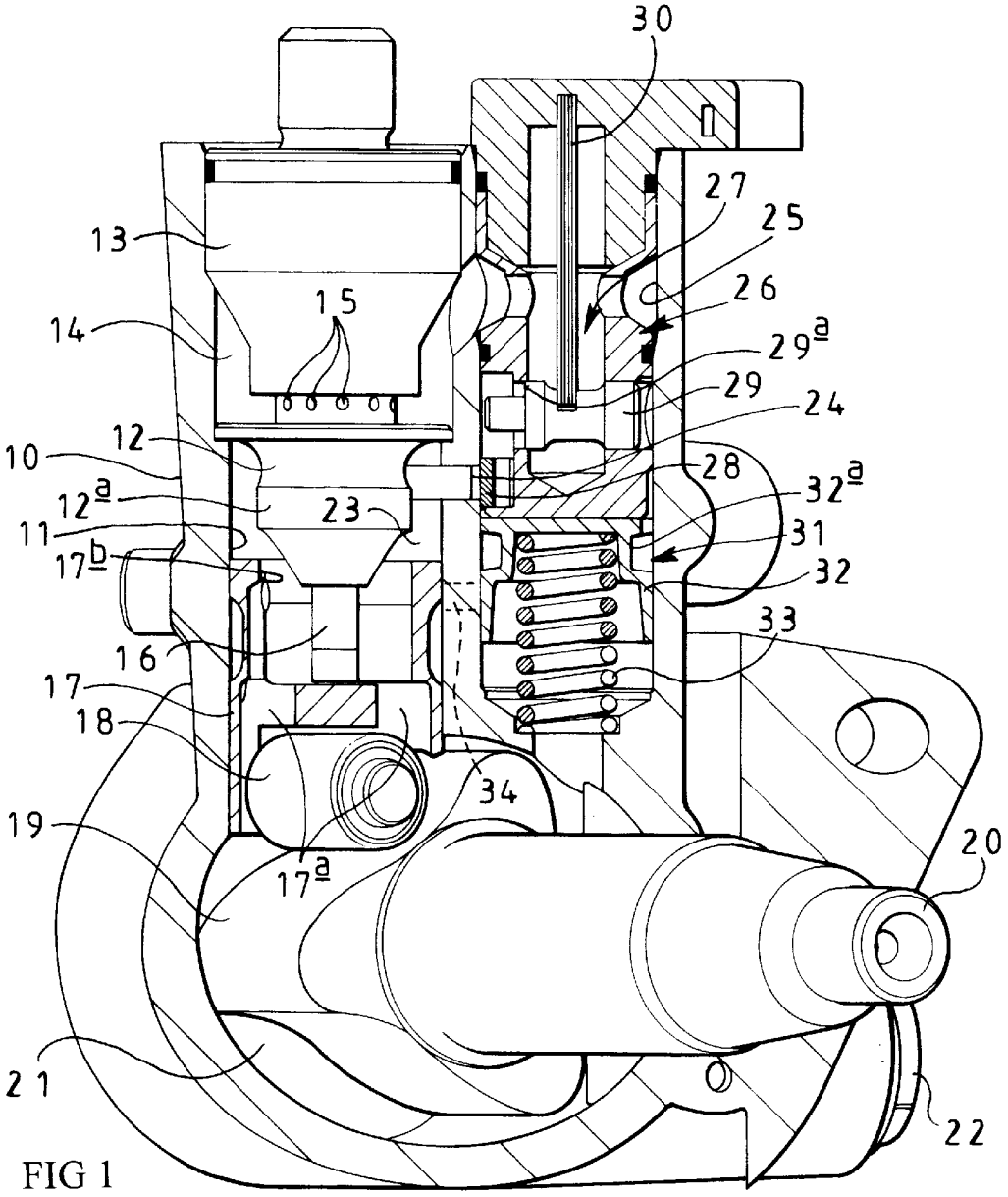
FIG. 1 is a sectional view illustrating a fuel pump in accordance with an embodiment of the invention.
Figure 2:
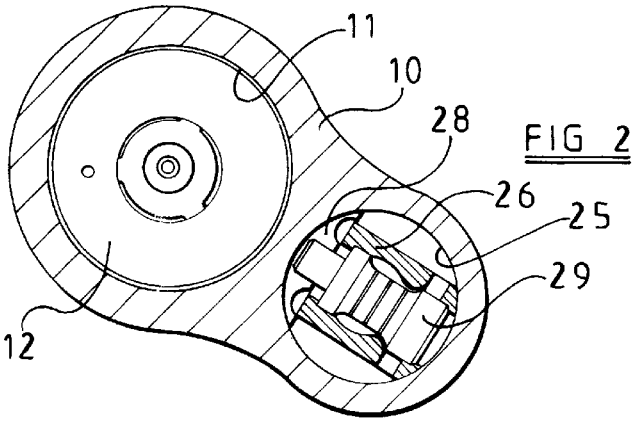
FIG. 2 is a diagrammatic sectional view of the pump of FIG. 1.

The fuel pump illustrated in the accompanying drawings comprises a pump body 10 having a bore 11 formed therein. A pump housing 12 is located within the bore 11, the pump housing 12 being clamped in position by means of an accumulator housing 13, which is in screw-threaded engagement within the bore 11. The pump housing 12, bore 11 and accumulator housing 13 together define an inlet chamber 14 which communicates through passages 15 formed in a seating member located between the accumulator housing 13 and the pump housing 12 with a further through bore (not shown) provided in the pump housing 12. An inlet valve arrangement is provided to control fuel flow along the passages 15 towards the further bore, permitting fuel to flow towards the further bore, but restricting fuel flow from the further bore towards the inlet chamber 14. The further bore further communicates through passages (not shown) with an accumulator chamber located within the accumulator housing 13. An outlet valve is provided which controls communication between the further bore of the pump housing 12 and the accumulator chamber, permitting fuel flow from the further bore towards the accumulator chamber, but preventing or restricting fuel flow in the reverse direction.

The further bore of the pump housing 12 defines a high pressure pumping chamber, a pumping plunger 16 being reciprocable within the further bore to vary the volume of the pumping chamber. The pumping plunger engages a tappet member 17 which carries a roller 18, the roller 18 being cooperable with a cam 19 carried by a drive shaft 20 such that upon rotation of the drive shaft 20, the roller 18 and tappet member 17 transmit reciprocating motion to the plunger member 16. The reciprocating motion is such that, as the plunger member 16 moves to reduce the volume of the pumping chamber, the fuel pressure within the pumping chamber rises and fuel is expelled from the pumping chamber through the outlet valve to the accumulator chamber, the inlet valve substantially preventing fuel flow towards the inlet chamber 14 from the pumping chamber. Once the pumping plunger 16 has reached its innermost position, retraction of the pumping plunger 16 increases the volume of the pumping chamber, reducing the fuel pressure therein. During this part of the motion of the pumping plunger 16, the outlet valve substantially prevents fuel flowing from the accumulator chamber towards the pumping chamber, and fuel is able to flow from the inlet chamber 14 through the passages 15 and inlet valve to the pumping chamber, charging the pumping chamber to a low pressure.

The tappet member 17 is held against angular movement by a pin carried by the body 10 which rides within a slot formed in the tappet member.

The pump body 10 defines a cam box 21 within which the cam 19 is located. The cam box 21 communicates through an inlet 22 with a low pressure fuel source, for example a fuel reservoir. The tappet member 17 is provided with openings 17*a* whereby fuel is able to flow to an auxiliary pumping chamber 23 defined between the tappet member 17, the bore 11 formed in the pump body 10 and the pump housing 12.

The pump housing 12 includes a region 12*a* of outer diameter substantially equal to the diameter of a bore 17*b* formed in the tappet member 17. The outer diameter of the tappet member 17 is substantially equal to the diameter of the bore 11. In the position illustrated in FIG. 1, the tappet member 17 is positioned such that the region 12*a* of the pump housing is not received within the bore 17*b*. In this position, the auxiliary pumping chamber 23 communicates with the cam box 21. Movement of the tappet member 17 under the action of the cam 19 lifts the tappet member 17, and a point will be reached at which the region 12*a* is received within the bore 17*b* of the tappet member 17, breaking communication between the cam box 21 and the auxiliary pumping chamber 23. The tappet member 17 and the pump housing 12 together form a valve controlling the flow of fuel between the cam box 21 and the auxiliary pumping chamber 23.

The auxiliary pumping chamber 23 is provided with a recess 24 forming an outlet from the auxiliary pumping chamber 23. The outlet communicates with a second bore 25 provided in the pump body 10. The second bore 25 houses a valve housing 26. The valve housing 26 defines a flow path 27 whereby fuel is able to flow from the auxiliary pumping chamber 23 to the inlet chamber 14. Within the flow path 27, an outlet valve 28 is provided, the outlet valve 28 being arranged to permit fuel flow from the auxiliary pumping chamber 23 along the flow path 27 towards the inlet chamber 14, but to substantially prevent flow in the reverse direction. The valve housing 26 further houses a metering valve arranged to control the rate at which fuel is able to flow along the flow path 27. The metering valve, in the arrangement illustrated, takes the form of a spool 29, the position of which controls the rate at which fuel is able to flow along the flow path 27, and a piezoelectric bender actuator 30, the energization level of which controls the position occupied by the spool member 29. In the position illustrated, the spool 29 occupies a position in which the flow path 27 is closed. Energization of the actuator 30 to move the spool 29 towards the right in the orientation illustrated lifts a metering edge 29*a* of the spool 29 away from a surface of a bore forming part of the flow path 27 to permit fuel to flow along the flow path 27. Although in the arrangement illustrated, the metering valve takes the form of a piezoelectrically actuated valve, it will be appreciated that any alternative type of metering valve could be used.

The second bore 25 further accommodates a pressure regulator 31 in the form of a piston member 32 which is biased by means of a spring 33 towards a position in which the piston member 32 closes a passage 34 interconnecting the second bore 25 and the bore 11. The piston member 32 is provided with an annular recess which forms an annular chamber 32*a* which communicates with the flow path 27. In use, in the event that the fuel pressure within the flow path 27 exceeds a predetermined pressure, then the force exerted on the piston member 32 by the fuel under pressure within the flow passage 27 urges the piston member 32 against the action of the spring 33 to a position in which the annular chamber 32*a* communicates with the passage 34, thereby permitting fuel to flow at a restricted rate from the flow path 27 to the bore 11, relieving the fuel pressure within the flow path 27.

In use, starting from the position illustrated in which the tappet member 17 and the pumping plunger 16 occupy their retracted, outermost positions, and in which both the auxiliary pumping chamber 23 and the pumping chamber defined by the further bore of the pump housing 12 are charged with fuel at a relatively low pressure, rotation of the drive shaft 20 and cam 19 causes movement of the roller 18 and tappet member 17 in an upward direction in the orientation illustrated. The movement of the tappet member 17 and the pumping plunger 16 compresses the fuel within the high pressure pumping chamber. The presence of the inlet valve prevents fuel from flowing from the pumping chamber towards the inlet chamber 14. As the pressure increases, a point will be reached beyond which the fuel pressure is able to open the outlet valve, thereby permitting fuel to flow from the high pressure pumping chamber to the accumulator chamber.

During the initial part of the movement of the tappet member 17, prior to the tappet member 17 reaching a position in which the region 12*a* of the pump housing 12 is located within the bore 17*b*, the movement of the tappet member 17 does not significantly alter the fuel pressure within the auxiliary pumping chamber 23, but rather fuel is displaced from the auxiliary pumping chamber 23 between the pump housing 12 and the tappet member 17. However, once the tappet member 17 has moved by a sufficient distance that the part 12*a* is received within the bore 17*b*, then further movement of the tappet member 17 compresses the fuel within the auxiliary pumping chamber 23, and a point will be reached beyond which the fuel pressure within the auxiliary pumping chamber 23 is sufficient to open the outlet valve 28, permitting fuel from the auxiliary pumping chamber 23 to flow into and along the flow path 27 towards the inlet chamber 14. The rate at which fuel can flow along the flow path 27 is governed by the metering valve arrangement.

Clearly, during the initial part of the movement of the tappet member 17, pressurisation of fuel occurs only within the high pressure pumping chamber, subsequent movement of the tappet member 17 pressurising fuel in both the high pressure pumping chamber and the auxiliary pumping chamber 23.

It will be appreciated that whilst the tappet member 17 is moving in an upward direction to pressurize and discharge fuel from the auxiliary pumping chamber 23, the pumping plunger 16 is also moving in an upward direction. Thus, whilst fuel is being expelled from the auxiliary pumping chamber 23, it is unable to flow into the high pressure pumping chamber. The fluid expelled from the auxiliary pumping chamber 23 serves to pressurize the inlet chamber 14 and the flow path 27. The operation of the pressure regulator serves, in conjunction with the volumes of these parts of the pump, to accommodate the fuel displaced thereto from the auxiliary pumping chamber 23, and to store sufficient fuel under a sufficient moderate pressure to subsequently charge the high pressure fuel pumping chamber.

Once the tappet 17 and pumping plunger 16 have reached their innermost positions, retraction of these components occurs, for example by virtue of the fuel pressure within the accumulator acting upon a piston associated with the pumping plunger 16, or by using a return spring. The retraction of the tappet member 17 draws a vacuum within the auxiliary pumping chamber 23, the vacuum being broken when the tappet member 17 moves to a position in which the part 12*a* of the pump housing is no longer received within the bore 17*b*. Once this position has been reached, fuel from the cam box 21 is able to flow to the auxiliary pumping chamber 23, charging the auxiliary pumping chamber 23 to a low pressure ready for the commencement of the next pumping cycle. The retraction of the pumping plunger 16 reduces the fuel pressure within the high pressure pumping chamber to an extent sufficient to ensure that the outlet valve thereof closes and the inlet valve opens to permit fuel from the inlet chamber 14 to flow to the high pressure pumping chamber, charging the high pressure pumping chamber to a relatively low level. The fuel pump is then ready for the commencement of the next pumping cycle which occurs when the roller 18 moves into engagement with the next cam lobe of the cam 19.

It will be appreciated that, in use, the fuel pressure within the flow path 27 varies. The pressure regulator 31 is used to reduce the pressure fluctuations within the flow path 27 and to prevent the fuel pressure within the flow path 27 exceeding a predetermined level. As described hereinbefore, the piston member 32 is exposed to the fuel pressure within the flow path 27, the fuel pressure within the flow path 27 applying a force to the piston member 32 acting against the action of the spring 33. In the position shown, the piston member 32 is urged by the spring 33 to a position in which a passage 34 is closed. In the event that the fuel pressure within the flow path 27 exceeds a predetermined level, then the piston member 32 will move against the action of the spring 33 and may move to a position in which the annular chamber 32*a* communicates with the passage 34 whereon fuel is able to flow from the flow path 27 to the passage 34 and through the passage 34 to the bore 11 and the cam box 21. The movement of the piston member 32 serves both to permit a desired quantity of fuel to be stored under moderate pressure to permit charging of the high pressure pumping chamber within an acceptable time period, and to avoid the generation of excessive fuel pressures within the flow path 27.

If desired, the pump may include an auxiliary outlet port whereby fuel may be supplied from the flow path 27 under moderate pressure to one or more auxiliary devices, for example air venting orifices or venturi type suction pumps.

What is claimed is:

1. A fuel pump comprising pumping plunger reciprocal within a bore formed in a pump housing under the influence of a cam drive arrangement, a portion of the bore forming a pumping chamber, the cam drive arrangement including a reciprocal tappet member, a surface associated with the tappet member defining, in part, an auxiliary pumping chamber, and a flow path interconnecting the auxiliary pumping chamber and the pumping chamber such that fuel displaced from the auxiliary pumping chamber, in use, can be supplied through the flow path to the pumping chamber.

2. The fuel pump as claimed in claim 1, wherein the auxiliary pumping chamber is defined between the tappet member and the pump housing.

3. The fuel pump as claimed in claim 1, wherein the tappet member is arranged to be moveable to a position in which the tappet member is spaced from the pump housing, thereby permitting fuel to flow to the auxiliary pumping chamber.

4. The fuel pump as claimed in claim 3, further comprising an outlet valve provided in the flow path, the outlet valve being arranged to prevent the return of fuel to the auxiliary pumping chamber, in use.

5. The fuel pump as claimed in claim 1, further comprising a metering valve provided in the flow path.

6. The fuel pump as claimed in claim 5, wherein the metering valve takes the form of a piezoelectrically controlled metering valve.

7. The fuel pump as claimed in claim 1, further comprising a pressure regulator arranged to control the fuel pressure within the flow path.

8. The fuel pump as claimed in claim 7, whereby the pressure regulator controls the fuel pressure by controlling the rate at which fuel is able to escape from the flow path.

9. The fuel pump as claimed in claim 7, wherein the pressure regulator comprises a resiliently biased piston member, a surface of the piston member being exposed to fuel pressure within the flow path.

10. The fuel pump as claimed in claim 1, wherein the tappet member is reciprocable within an additional bore provided in a pump body part, the tappet member being provided with an arrangement for substantially preventing relative angular movement of the tappet member with respect to the pump body part.

11. A fuel pump, comprising:

a pump housing having a first bore;

a pump body disposed within the first bore and defining a second bore;

a pumping plunger being reciprocally disposed within the second bore, the pumping plunger and the second bore defining a pumping chamber;

a tappet member reciprocally disposed with the first bore and being coupled to the pumping plunger, the first bore, the tappet member, and the pump body defining an auxiliary pumping chamber; and a flow path interconnecting the pumping chamber and the auxiliary pumping chamber.

12. A fuel pump, as set forth in claim 11, wherein the tappet member is moveable between first and second positions, a volume of the auxiliary pumping chamber being modified as a result of movement of the tappet member between the first and second positions.

13. A fuel pump, as set forth in claim 11, wherein the pumping plunger is moveable between first and second positions, a volume of the pumping chamber being modified as a result of movement of the tappet member between the first and second positions.

14. A fuel pump, as set forth in claim 11, including:

a roller coupled to the tappet member; and a cam shaft engaged with the roller.

15. A fuel pump, as set forth in claim 11, wherein the tappet member is adapted to be moveable to a position in which the tappet member is spaced from the pump housing, thereby permitting fuel to flow to the auxiliary pumping chamber.

16. A fuel pump, as set forth in claim 15, further comprising an outlet valve provided in the flow path, the outlet valve being adapted to prevent the return of fuel to the auxiliary pumping chamber.

17. A fuel pump, as set forth in claim 11, including a metering valve provided in the flow path.

18. A fuel pump, as set forth in claim 11, including a pressure regulator arranged to control the fuel pressure within the flow path.

19. A fuel pump, as set forth in claim 11, including:

an accumulator housing forming an accumulator chamber coupled to the pumping chamber, the pumping plunger being adapted to expel fuel from the pumping chamber to the accumulator chamber.

20. A fuel pump, as set forth in claim 19, wherein the flow path is adapted to permit fuel to flow from the auxiliary pumping chamber to the pumping chamber when pressure of fuel within the auxiliary pumping chamber reaches a predetermined threshold.

* * * * *